US009928766B2

(12) United States Patent
Kim et al.

(10) Patent No.: US 9,928,766 B2
(45) Date of Patent: Mar. 27, 2018

(54) TEST STRUCTURE, ARRAY SUBSTRATE HAVING THE SAME AND METHOD OF MEASURING SHEET RESISTANCE USING THE SAME

(71) Applicant: SAMSUNG DISPLAY CO., LTD., Yongin, Gyeonggi-Do (KR)

(72) Inventors: Jong-Yun Kim, Yongin-si (KR); Jin-Taek Kim, Suwon-si (KR); Cheol-Ho Yu, Yongin-si (KR); Bong-Won Lee, Seoul (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 621 days.

(21) Appl. No.: 14/084,965

(22) Filed: Nov. 20, 2013

(65) Prior Publication Data

US 2015/0015296 A1 Jan. 15, 2015

(30) Foreign Application Priority Data

Jul. 15, 2013 (KR) ..... 10-2013-0082557

(51) Int. Cl.
*G09G 3/00* (2006.01)

(52) U.S. Cl.
CPC ..... *G09G 3/006* (2013.01)

(58) Field of Classification Search
CPC ..... G09G 3/006; H01L 2924/00; H01L 2924/0002; H01L 22/34; H01L 22/12; H01L 22/14; G01R 31/2884; G01R 31/26; G01R 27/02; G01R 27/14; G01R 1/0408; G02F 1/13452; G02F 1/1309
USPC ..... 324/760.01–760.02
See application file for complete search history.

(56) References Cited

U.S. PATENT DOCUMENTS

| | | | | |
|---|---|---|---|---|
| 6,403,389 | B1 | 6/2002 | Chang et al. | |
| 7,030,633 | B1 * | 4/2006 | Qiu | G01N 27/045 257/E21.531 |
| 7,626,402 | B2 | 12/2009 | Sakamoto | |
| 2002/0079920 | A1 * | 6/2002 | Fujikawa | G02F 1/1309 324/754.07 |
| 2005/0017746 | A1 * | 1/2005 | Matsumoto | G01R 31/2884 324/762.03 |

(Continued)

FOREIGN PATENT DOCUMENTS

| | | |
|---|---|---|
| JP | 2005-223227 | 8/2005 |
| KR | 1020000014675 | 3/2000 |

*Primary Examiner* — Tung X Nguyen
*Assistant Examiner* — Lee Rodak
(74) *Attorney, Agent, or Firm* — F. Chau & Associates, LLC

(57) ABSTRACT

A test structure includes a terminal pattern, a first extending part, a second extending part and a measuring part. The terminal pattern includes a first terminal part, a second terminal part, a third terminal part and a fourth terminal part sequentially disposed and spaced apart from each other in a first direction. The first extending part is connected to the first terminal part and the second terminal part. The first extending part extends in a second direction crossing the first direction. The second extending part is connected to the third terminal part and the fourth terminal part. The second extending part extends in the second direction. The measuring part partially overlaps the first extending part and the second extending part.

16 Claims, 6 Drawing Sheets

(56) References Cited

U.S. PATENT DOCUMENTS

2009/0153173 A1* 6/2009 Arasawa ..... H01L 22/32
324/762.02

* cited by examiner

TEST STRUCTURE, ARRAY SUBSTRATE HAVING THE SAME AND METHOD OF MEASURING SHEET RESISTANCE USING THE SAME

CROSS-REFERENCE TO RELATED APPLICATIONS

This application claims priority under 35 U.S.C. § 119 to Korean Patent Application No. 10-2013-0082557, filed on Jul. 15, 2013, the disclosure of which is incorporated by reference herein in its entirety.

TECHNICAL FIELD

Exemplary embodiments of the present invention relate to a test structure, an array substrate having the test structure, and a method of measuring sheet resistance using the test structure. More particularly, exemplary embodiments of the present invention relate to a test structure, an array substrate having the test structure, and a method of measuring sheet resistance using the test structure that are capable of improving the accuracy of a sheet resistance measurement.

DISCUSSION OF THE RELATED ART

A display apparatus typically includes an array substrate and an opposing substrate facing the array substrate. Control signals are applied to a plurality of pixel electrodes through signal lines on the array substrate. The pixel electrodes are disposed in a display region of the array substrate. A liquid crystal layer may be disposed between the array substrate and the opposing substrate. The liquid crystal layer includes liquid crystals whose arrangements are adjusted by an electric field generated from the control signals. Alternatively, an organic light emitting layer may be disposed between the array substrate and the opposing substrate. The organic light emitting layer may generate light having a desired wavelength by the electric field generated from the control signals.

When the array substrate includes the signal lines or the pixel electrodes, the signal lines or the pixel electrodes may be inspected to determine whether each of the signal lines or the pixel electrodes is operating as designed. When one of the signal lines or pixel electrodes is found to be non-operative or malfunctioning, the signal line or pixel electrode may be repaired to improve yield rate of the array substrate.

The array substrate may include a plurality of test element group (TEG) patterns having a predetermined shape and area in a peripheral region. The TEG patterns are used to inspect the signal lines or the pixel electrodes. A desired current or voltage may be applied to the TEG patterns to measure sheet resistance of the signal lines or pixel electrodes.

If a boundary portion of a TEG pattern for measuring sheet resistance of the pixel electrodes is overly etched during an etching process of the pixel electrodes, an error may occur during the testing process with respect to the true value of the sheet resistance.

SUMMARY

Exemplary embodiments of the present invention provide a test structure capable of measuring sheet resistance of a TEG pattern for testing pixel electrodes, a method of measuring the sheet resistance using the test structure, and an array substrate having the test structure.

In an exemplary embodiment of the present invention, a test structure includes a terminal pattern, a first extending part, a second terminal part and a measuring part. The terminal pattern includes a first terminal part, a second terminal part, a third terminal part and a fourth terminal part sequentially disposed and spaced apart from each other in a first direction. The first extending part is connected to the first terminal part and the second terminal part. The first extending part extends in a second direction crossing the first direction. The second extending part is connected to the third terminal part and the fourth terminal part. The second extending part extends in the second direction. The measuring pattern partially overlaps the first extending part and the second extending part.

In an exemplary embodiment, the measuring pattern may be disposed between the second terminal part and the third terminal part.

In an exemplary embodiment, a width of the measuring pattern may be greater than a length of the measuring pattern.

In an exemplary embodiment, the width of the measuring pattern may be about ten times greater than the length of the measuring pattern.

In an exemplary embodiment, the measuring pattern may include a transverse side and a longitudinal side, and one of the transverse side and the longitudinal side may be substantially parallel with the first direction or the second direction.

In an exemplary embodiment, a direction of the width of the measuring pattern may partially extend in a diagonal direction with respect to the first direction and the second direction.

In an exemplary embodiment, a direction of the width of the measuring pattern may partially extend in the first direction and the second direction.

In an exemplary embodiment, the measuring pattern may have one of a zigzag shape, an S shape and a Z shape.

In an exemplary embodiment, the measuring pattern may include a transparent conductive material.

In an exemplary embodiment, the measuring pattern may include indium tin oxide.

In an exemplary embodiment of the present invention, a method of measuring a sheet resistance using a test structure includes connecting a current generator to a first terminal part and a fourth terminal part of a terminal pattern, wherein the terminal pattern includes the first terminal part, a second terminal part, a third terminal part and the fourth terminal part sequentially disposed and spaced apart from each other in a first direction, the first terminal part is connected to a first extending part that extends in a second direction crossing the first direction, and the fourth terminal part is connected to a second extending part that extends in the second direction, connecting a voltmeter to the second terminal part and the third terminal part, wherein the second terminal part is connected to the first extending part, and the third terminal part is connected to the second extending part, applying a current through the first and fourth terminal parts by the current generator, and measuring a voltage through the second and third terminal parts by the voltmeter while the current is applied through the first and fourth terminal parts to compute a sheet resistance of a measuring part, wherein the measuring part partially overlaps the first extending part and the second extending part.

In an exemplary embodiment, a width of the measuring pattern may be greater than a length of the measuring pattern.

In an exemplary embodiment, a width of the measuring pattern may be about ten times greater than the length of the measuring pattern.

In an exemplary embodiment, the measuring pattern may include a transverse side and a longitudinal side, and one of the transverse side and the longitudinal side may be substantially parallel with the first direction or the second direction.

In an exemplary embodiment, a direction of the width of the measuring pattern may partially extend in the first direction and the second direction.

In an exemplary embodiment of the present invention, an array substrate includes a display region including a plurality of signal lines, a peripheral region including a driving circuit configured to provide an electrical signal to at least one of the signal lines, wherein the peripheral region is disposed adjacent to the display region, and a test region disposed in the peripheral region and including a plurality of test element group patterns, wherein the test region is spaced apart from the driving circuit. The test region includes a terminal pattern including a first terminal part, a second terminal part, a third terminal part and a fourth terminal part sequentially disposed and spaced apart from each other in a first direction, a first extending part connected to the first terminal part and the second terminal part, wherein the first extending part extends in a second direction crossing the first direction, a second extending part connected to the third terminal part and the fourth terminal part, wherein the second extending part extends in the second direction, and a measuring part partially overlapping the first extending part and the second extending part.

In an exemplary embodiment, a width of the measuring pattern may be greater than a length of the measuring pattern.

In an exemplary embodiment, a width of the measuring pattern may be about ten times greater than the length of the measuring pattern.

In an exemplary embodiment, the measuring pattern may include a transverse side and a longitudinal side, and one of the transverse side and the longitudinal side may be substantially parallel with the first direction or the second direction.

In an exemplary embodiment, the display region may include a pixel electrode, and the measuring pattern may include the same material as the pixel electrode.

According exemplary embodiments of the test structure, the array substrate having the same and the method of measuring the sheet resistance using the same, the width of the TEG pattern for testing pixel electrodes may be elongated to reduce an error of sheet resistance measured by the TEG pattern for pixel electrodes when the pixel electrode layer is overly etched.

Further, according to exemplary embodiments, the width of the TEG pattern for testing pixel electrodes may be elongated while the length of the TEG pattern is fixed, thereby preventing an unnecessary increase of an area of the test region.

BRIEF DESCRIPTION OF THE DRAWINGS

The above and other features will become more apparent by describing in detail exemplary embodiments thereof with reference to the accompanying drawings, in which.

DETAILED DESCRIPTION OF THE EXEMPLARY EMBODIMENTS

Figure 1:
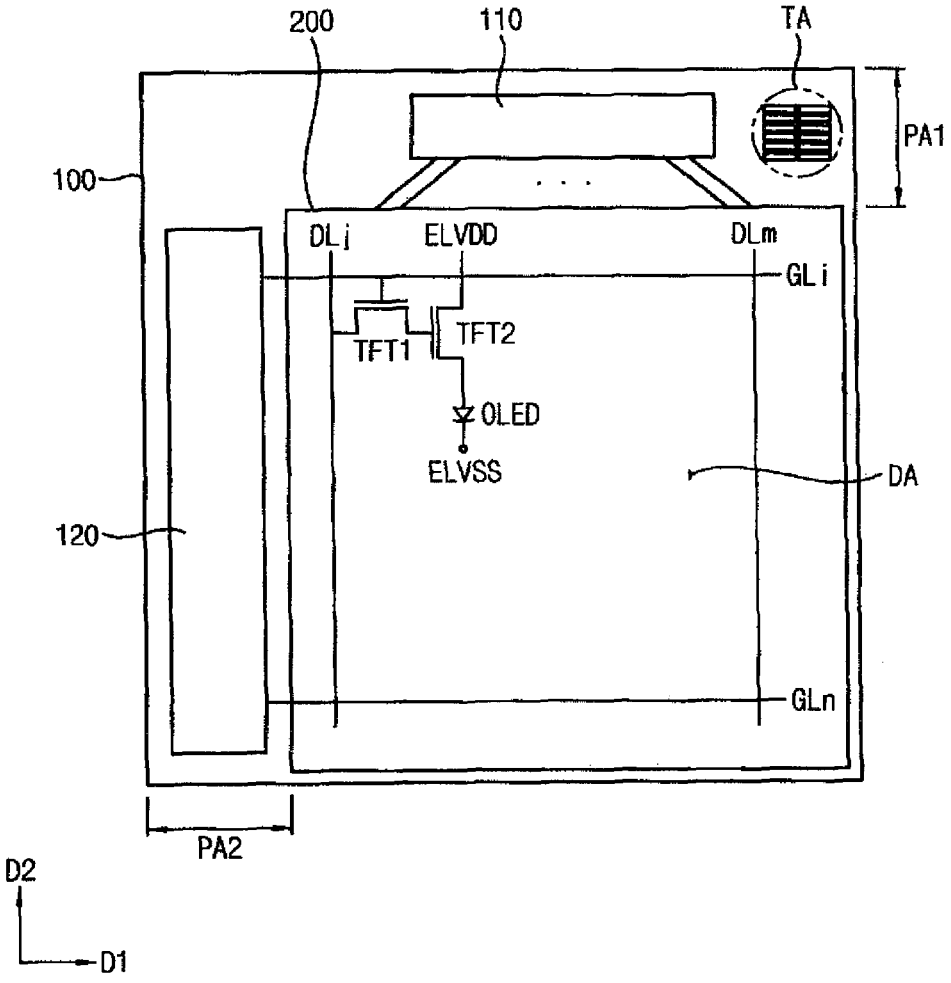
FIG. 1 is a plan view illustrating a display apparatus, according to an exemplary embodiment of the present invention.

Exemplary embodiments of the present invention will be described more fully hereinafter with reference to the accompanying drawings. Like reference numerals may refer to like elements throughout the accompanying drawings.

It will be understood that when an element or layer is referred to as being "on", "connected to", "coupled to", or "adjacent to" another element or layer, it can be directly on, connected, coupled, or adjacent to the other element or layer, or intervening elements or layers may be present. It will also be understood that when an element or layer is referred to as being "between" two elements or layers, it can be the only element or layer between the two elements or layers, or one or more intervening elements or layers may also be present.

FIG. 1 is a plan view illustrating a display apparatus, in accordance with an exemplary embodiment of the present invention.

Referring to FIG. 1, a display apparatus according to an exemplary embodiment includes an array substrate 100 and an opposing substrate 200 facing the array substrate 100. The array substrate 100 may include a display region DA that displays an image, a first peripheral region PA1, and a second peripheral region PA2. The first and second peripheral regions PA1 and PA2 may each be adjacent to the display region DA.

In the display region DA of the array substrate 100, m data lines DL (e.g., data lines DLj to DLm) may be disposed parallel, or substantially parallel to one another along a first direction D1, and n gate lines GL (e.g., GLi to GLn) may be disposed parallel, or substantially parallel to one another along a second direction D2. Each of the data lines DL may extend in the second direction D2, and each of the gate lines GL may extend in the first direction D1. The gate lines GL and the data lines DL provide an electric signal to unit pixel regions. When the display apparatus includes an organic light emitting element, a first power voltage providing line ELVDD and a second power voltage providing line ELVSS may be further disposed adjacent to the data lines DL in the display region DA. The first power voltage providing line ELVDD and the second power voltage providing line ELVSS extend in the second direction D2.

Each unit pixel region may include a first switching element TFT1, a second switching element TFT2, and an organic light emitting element OLED.

A gate electrode of the first switching element TFT1 may be electrically connected to a gate line GLi, and a source electrode of the first switching element TFT1 may be electrically connected to a data line DLj. A drain electrode of the first switching element TFT1 may be electrically connected to a gate electrode of the second switching element TFT2. A source electrode of the second switching element TFT2 may be electrically connected to the first power voltage providing line ELVDD, and a drain electrode of the second switching element TFT2 may be electrically connected to the organic light emitting element OLED. The second power voltage providing line ELVSS may be electrically connected to the organic light emitting element OLED.

The first peripheral region PA1 may be disposed in an upper region of the array substrate 100, adjacent to an upper region of the display region DA, as shown in FIG. 1. The first peripheral region PA1 may include a data driving part 110 and a test region TA. In an exemplary embodiment, the test region TA may be disposed in the second peripheral region PA2.

The data driving part 110 may be electrically connected to a first end of each data line DL. The data driving part 110 may provide a data signal to each of the data lines DL.

The test region TA may be disposed adjacent to the data driving part 110. For example, the test region TA may be disposed in a side region of the first peripheral region PA1 and may be spaced apart from the data driving part 110.

The second peripheral region PA2 may be disposed in a side region of the array substrate 100, adjacent to a side region of the display region DA. The second peripheral region PA2 may include a gate driving part 120.

The gate driving part 120 may be electrically connected to a first end of each gate line GL. The gate driving part 120 may provide a gate on/off signal to each of the gate lines GL.

Although FIG. 1 shows the data driving part 110 disposed in a top region of the array substrate 100, and shows the gate driving part 120 disposed in a left region of the array substrate 100, the respective locations of the data driving part 100 and the gate driving part 120 are not limited thereto. For example, in exemplary embodiments, the data driving part 110 may be disposed in a bottom region of the array substrate 100, adjacent to a bottom region of the display region DA, and the gate driving part 120 may be disposed in the opposite side region of the array substrate 100, adjacent to the opposite side region of the display region DA.

Figure 2:
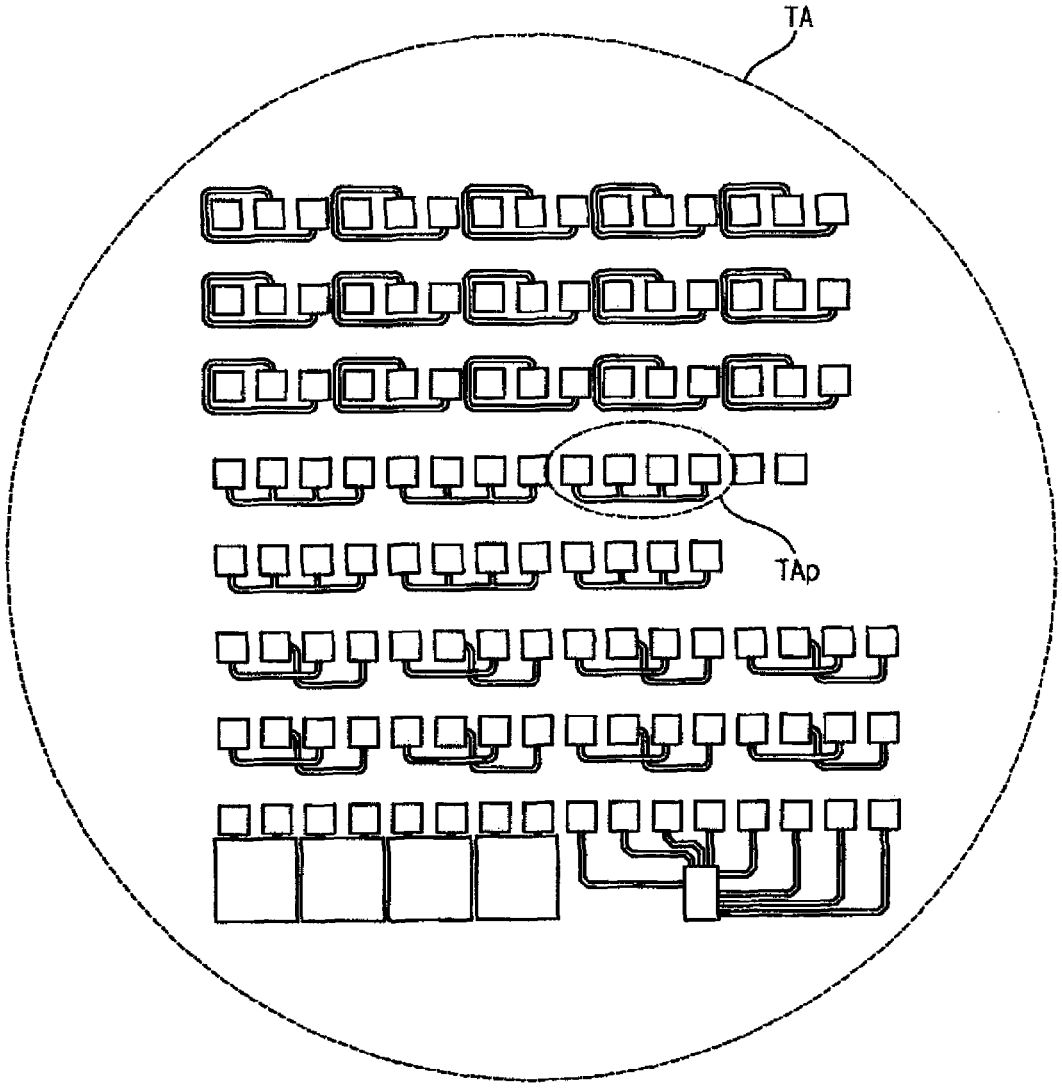
FIG. 2 is an enlarged plan view illustrating a test region of FIG. 1, according to an exemplary embodiment of the present invention.

FIG. 2 is an enlarged plan view illustrating a test region of FIG. 1, according to an exemplary embodiment of the present invention.

Referring to FIG. 2, the test region TA may include a plurality of test element group ("TEG") patterns. The TEG patterns may be used to inspect electrical properties of signal lines or signal electrodes on the array substrate 100. For example, the TEG patterns may include a TEG pattern for gate lines, a TEG pattern for source/drain electrodes, or a TEG pattern for pixel electrodes. The TEG patterns may be used to measure sheet resistance of the signal lines or signal electrodes. In the exemplary embodiment shown in FIG. 2, the test region TA includes a region TAp having a TEG pattern arranged therein for pixel electrodes arranged on the array substrate 100.

Figure 3:
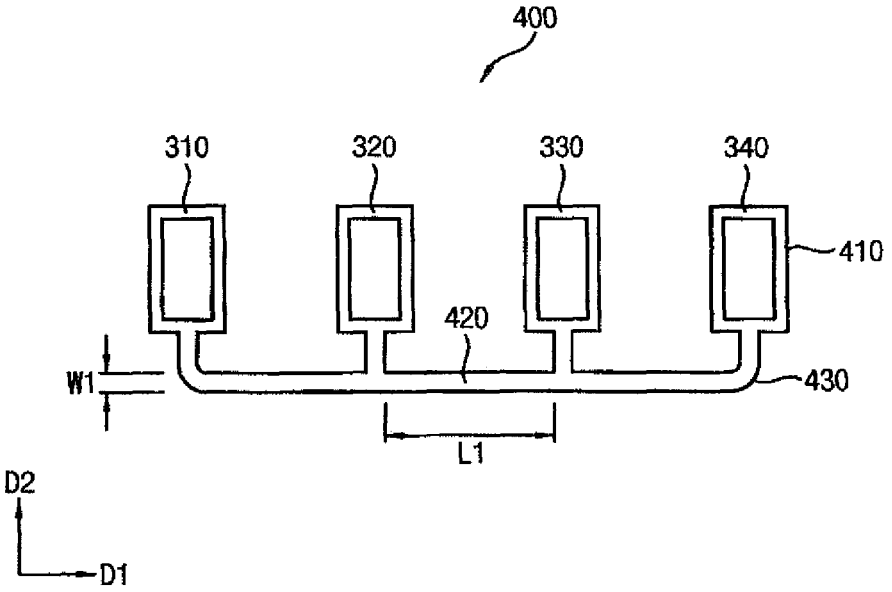
FIG. 3 is an enlarged plan view illustrating a test region for testing pixel electrodes of FIG. 2, according to an exemplary embodiment of the present invention.

FIG. 3 is an enlarged plan view illustrating a test region for testing pixel electrodes of FIG. 2, according to an exemplary embodiment of the present invention.

Referring to FIG. 3, a TEG pattern 400 for testing pixel electrodes according to an exemplary embodiment includes a first terminal part 310, a second terminal part 320, a third terminal part 330 and a fourth terminal part 340. The first to fourth terminal parts 310 to 340 are spaced apart from each other along a first direction D1. Each of the first to fourth terminal parts 310 to 340 may include an opaque metal. For example, each of the first to fourth terminal parts 310 to 340 may include the same material as the material used to form the data lines DL or the gate lines GL. For example, the first to fourth terminal parts 310 to 340 and the data lines DL or the gate lines GL may be formed in the same process. A portion of the TEG pattern 400 that includes the first to fourth terminal parts 310 to 340 may be referred to herein as a terminal pattern.

The TEG pattern 400 for testing pixel electrodes may further include an overlap portion 410 and a connection portion 430. The connection portion 430 may be integrally formed with the overlap portion 410. The overlap portion 410 may overlap the first terminal part 310, the second terminal part 320, the third terminal part 330 and the fourth terminal part 340. A transparent insulation layer may be further disposed between the overlap portion 410 and the first to fourth terminal parts 310 to 340. For example, the overlap portion 410 may be disposed on the transparent insulation layer under which the first to fourth terminal parts 310 to 340 are formed.

The connection portion 430 may extend in the first direction D1. The first to fourth terminal parts 310 to 340 may be disposed along the first direction D1, and may extend in a second direction D2 perpendicular to, or substantially perpendicular to the first direction D1 with respect to the connection portion 430. Thus, the connection portion 430 and the first to fourth terminal parts 310 to 340 may extend in perpendicular, or substantially perpendicular directions, and the first to fourth terminal parts 310 to 340 may be disposed parallel, or substantially parallel to each other. A measuring part 420 may be disposed between the second terminal part 320 and the third terminal part 330.

The measuring part 420 may have a first width W1 and a first length L1. The first length L1 may be greater than about 30 micrometers and less than about 500 micrometers, however the first length L1 is not limited thereto. In an exemplary embodiment, the first width W1 of the measuring part 420 may be about 30 micrometers, and the first length L1 of the measuring part 420 may be about 180 micrometers. The measuring part 420 may include a transparent conductive material. For example, the measuring part 420 may include indium tin oxide ("ITO"). For example, the measuring part 420 may include the same material as a pixel electrode disposed in the display region DA of the array substrate 100.

When measuring sheet resistance of a pixel electrode using the TEG pattern 400 for testing pixel electrodes, a current generator may be electrically connected to the first terminal part 310 and the fourth terminal part 340, while a voltmeter may be electrically connected to the second terminal part 320 and the third terminal part 330. Accordingly, a current may be applied through the first terminal part 310 and the fourth terminal part 340, and a voltage may be measured through the second terminal part 320 and the third terminal part 330, thereby measuring the sheet resistance of the measuring part 420.

The sheet resistance of the measuring part 420 may be defined, for example, by Equation 1:

$$Rs=(V/I)\times(W/L) \quad \text{[Equation 1]}$$

Referring to Equation 1, Rs represents the sheet resistance of the measuring part 420, V represents a voltage measured by the voltmeter, I represents a current provided by the current generator, W represents the first width W1 of the measuring part 420, and L represents the first length L1 of the measuring part 420. The unit of the sheet resistance may be ohms per square.

If the TEG pattern 400 for testing pixel electrodes is overly etched in an etching process of the pixel electrodes on the array substrate 100, the first width W1 and the first length L1 of the measuring part 420 may be changed. This change in the first width W1 and the first length L1 may result in an error in the results of the testing process relative to a true value of the sheet resistance of the measuring part 420. That is, the change in the first width W1 and the first length L1 may cause inaccurate test results relating to the sheet resistance of the measuring part 420.

Figure 4:
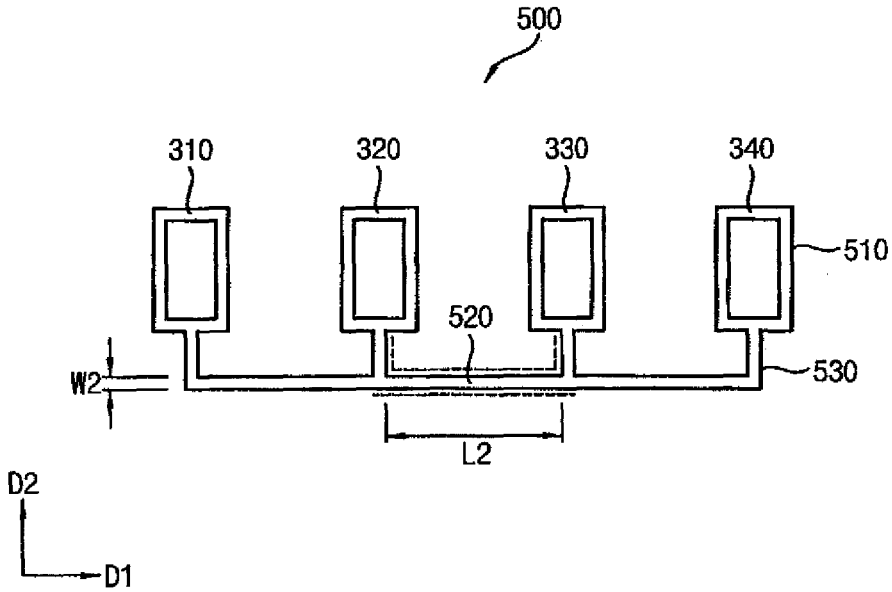
FIG. 4 is a plan view illustrating the TEG pattern for testing pixel electrodes of FIG. 3 when the TEG pattern is overly etched.

FIG. 4 is a plan view illustrating the TEG pattern for testing pixel electrodes of FIG. 3 when the TEG pattern is overly etched.

Referring to FIGS. 3 and 4, when a TEG pattern 500 for testing pixel electrodes is overly etched, a width and a length of the measuring part 520 may be changed. For example, a second width W2 of the measuring part 520 may be less than the first width W1 of the measuring part 420 in FIG. 3. Further, a second length L2 of the measuring part 520 may be greater than the first length L1 of the measuring part 420 in FIG. 3. Accordingly, when the TEG pattern 500 for testing pixel electrodes is overly etched in an etching process of the pixel electrodes on the array substrate 100, the second width W2 and the second length L2 of the measuring part 520 may be changed, resulting in an error in the results of the testing process relative to a true value of the sheet resistance of the measuring part 420. A portion of the TEG pattern 500 that includes the first to fourth terminal parts 310 to 340 may be referred to herein as a terminal pattern.

For example, when the measuring part 420 of the TEG pattern 400 is designed to have a first width W1 of about 30 micrometers and a first length L1 of about 180 micrometers, but is overly etched by about 3 micrometers both in width and length, the second width W2 of the measuring part 520 may be about 24 micrometers (e.g., 30−(3=2)), and the second length L2 of the measuring part 520 may be about 186 micrometers (e.g., 180+(3×2)). As a result, during testing, the sheet resistance of the measuring part 520 may be detected to have about a 20% error relative to the true value of the sheet resistance (e.g., [(30/180)−(24/186)]/(30/180)≈20%) due to over-etching.

Figure 5:
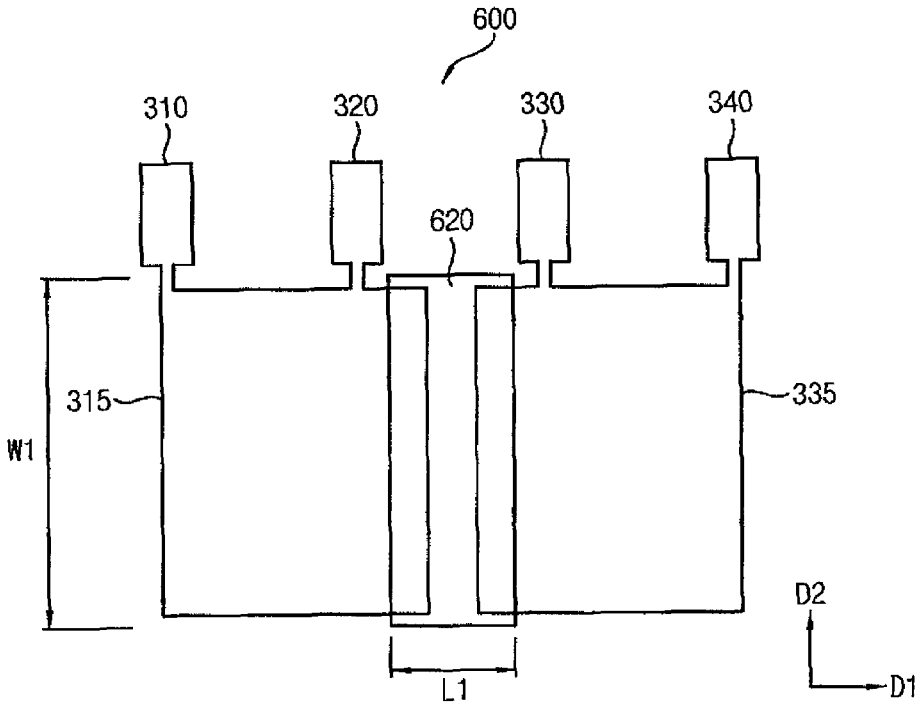
FIG. 5 is a plan view illustrating a TEG pattern for testing pixel electrodes, according to an exemplary embodiment of the present invention.

FIG. 5 is a plan view illustrating a EG pattern for testing pixel electrodes, according to an exemplary embodiment of the present invention.

Referring to FIG. 5, a TEG pattern 600 for testing pixel electrodes according to an exemplary embodiment includes a first terminal part 310, a second terminal part 320, a third terminal part 330 and a fourth terminal part 340. The first to fourth terminal parts 310 to 340 are spaced apart from one another along a first direction D1 The first terminal part 310 and the second terminal part 320 may be connected to each other through a first extending part 315. The first terminal part 310, the second terminal part 320 and the first extending part 315 may be integrally formed. The third terminal part 330 and the fourth terminal part 340 may be connected each other through a second extending part 335. The third terminal part 330, the fourth terminal part 340 and the second extending part 335 may be integrally formed. A portion of the TEG pattern 600 that includes the first to fourth terminal parts 310 to 340 may be referred to herein as a terminal pattern.

The first extending part 315 and the second extending part 335 may extend in a second direction D2 crossing the first direction D1 (e.g., the first and second directions D1 and D2 may be perpendicular, or substantially perpendicular to each other). A measuring part 620 may be disposed between the first extending part 315 and the second extending part 335.

The measuring part 620 may partially overlap the first extending part 315 and the second extending part 335. The measuring part 620 may include a transparent conductive material. For example, the measuring part 620 may include indium tin oxide (ITO). The measuring part 620 may have a first length L1 along the first direction D1 and a first width W1 along the second direction D2. The first width W1 may be greater than the first length L1. In an exemplary embodiment, the first width W1 may be about ten times larger than the first length L1.

Figure 6:
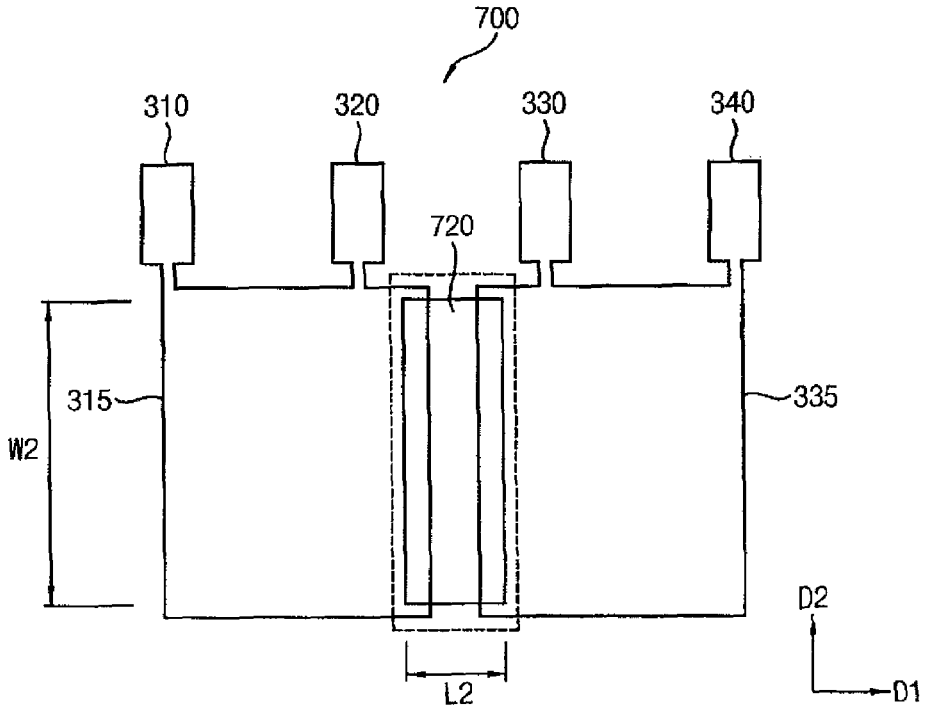
FIG. 6 is a plan view illustrating the TEG pattern for testing pixel electrodes of FIG. 5 when the TEG pattern is overly etched.

FIG. 6 is a plan view illustrating the TEG pattern for testing pixel electrodes of FIG. 5 when the TEG pattern is overly etched.

Referring to FIGS. 5 and 6, when a TEG pattern 700 for testing pixel electrodes is overly etched, a width and a length of the measuring part 720 may be changed. For example, a second width W2 of the measuring part 720 may be less than the first width W1 of the measuring part 620 in FIG. 5. Further, a second length L2 of the measuring part 720 may be less than the first length L1 of the measuring part 620 in FIG. 5. Accordingly, when the TEG pattern 700 for testing pixel electrodes is overly etched in an etching process of the pixel electrodes on the array substrate 100, the second width W2 and the second length L2 of the measuring part 720 may be changed, resulting in an error in the results of the testing process relative to a true value of the sheet resistance of the measuring part 620. Compared to the error caused by the over-etching referring to the exemplary embodiment described with reference to FIGS. 3 and 4, the error caused by the over-etching referring to the exemplary embodiment in FIGS. 5 and 6 may be less. A portion of the TEG pattern 700 that includes the first to fourth terminal parts 310 to 340 may be referred to herein as a terminal pattern.

For example, when the measuring part 720 of the TEG pattern 700 is designed to have a first width W1 of about 2,000 micrometers and a first length L1 of about 180 micrometers, but is overly etched by about 3 micrometers both in width and length, the second width W2 of the measuring part 720 may be about 1,994 micrometers (e.g., 2,000−(3×2)), and the second length L2 of the measuring part 720 may be about 174 micrometers (e.g., 180−(3×2)). As a result, during testing, the sheet resistance of the measuring part 720 may be detected to have about a 3% error relative to the true value of the sheet resistance (e.g., [(1994/174)−(2000/180)]/(2000/180)≈3%) due to over-etching.

As described above, an array substrate 100 according to an exemplary embodiment may include a TEG pattern 600 having an elongated width W1, which may reduce the amount of error relating to measuring the sheet resistance using the TEG pattern 600 for testing pixel electrodes when a pixel electrode layer is overly etched.

Further, in an exemplary embodiment, the width W3 of the TEG pattern 600 may be extended, while the length L1 of the TEG pattern 600 is fixed, thereby preventing an unnecessary increase of an area of the test region.

Figure 7:
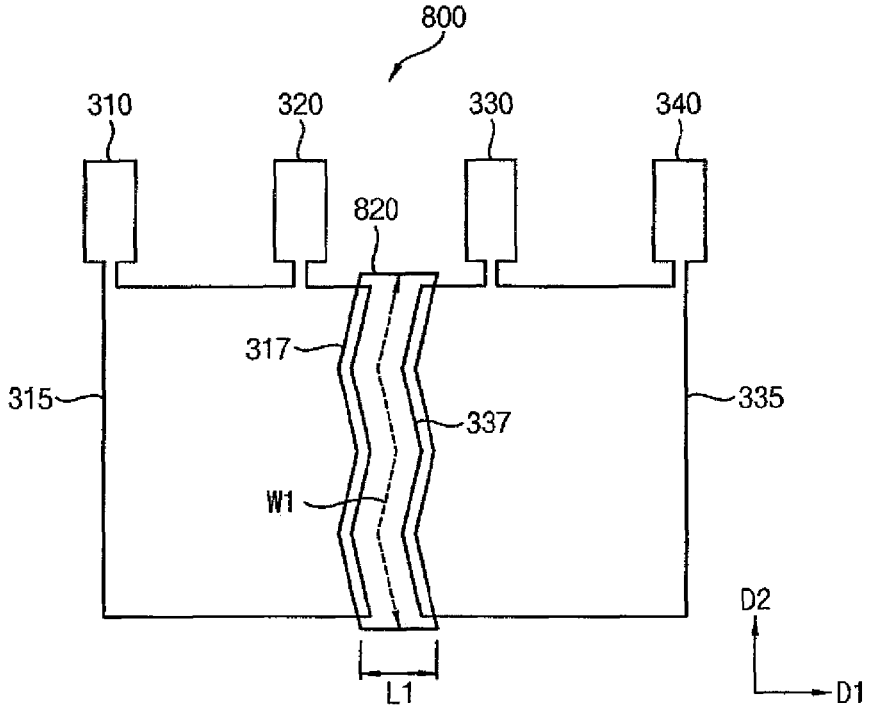
FIG. 7 is a plan view illustrating a TEG pattern for testing pixel electrodes, according to an exemplary embodiment of the present invention.

FIG. 7 is a plan view illustrating a TEG pattern for testing pixel electrodes, according to an exemplary embodiment of the present invention.

Referring to FIG. 7, a TEG pattern 800 for testing pixel electrodes according to an exemplary embodiment includes a first terminal part 310, a second terminal part 320, a third terminal part 330 and a fourth terminal part 340. The first to fourth terminal parts 310 to 340 are spaced apart from one another along a first direction D1. The first terminal part 310 and the second terminal part 320 may be connected to each other through a first extending part 315. The first terminal part 310, the second terminal part 320 and the first extending part 315 may be integrally formed. The third terminal part 330 and the fourth terminal part 340 may be connected to each other through a second extending part 335. The third terminal part 330, the fourth terminal part 340 and the second extending part 335 may be integrally formed. A portion of the TEG pattern 800 that includes the first to fourth terminal parts 310 to 340 may be referred to herein as a terminal pattern.

The first extending part 315 and the second extending part 335 may extend in a second direction D2 crossing the first direction D1 (e.g., the first and second directions D1 and D2 may be perpendicular, or substantially perpendicular to each other). A measuring part 820 may be disposed between the first extending part 315 and the second extending part 335. The measuring part 820 may partially overlap the first extending part 315 and the second extending part 335. The measuring part 820 may include a transparent conductive material.

In the exemplary embodiment shown in FIG. 7, an overlap portion of the first extending part 315, together with the measuring part 820, may have a substantially zigzag shape. Similarly, an overlap portion of the second extending part 335, together with the measuring part 820, may have the substantially zigzag shape. For example, a first boundary 317 of the first extending part 315 and a second boundary 337 of the second extending part 335 may be elongated in the direction having the zigzag shape, and may be spaced apart from each other. The measuring part 820 may correspond to the zigzag shape and may have a first length L1 and a first width W1 overlapping the first boundary 317 and the second boundary 337. In an exemplary embodiment, the first width W1 of the measuring part 820 may be about ten times greater than the first length L1 of the measuring part 820. In an exemplary embodiment, the first boundary 317 and the second boundary 337 may have a serpentine shape instead of a zigzag shape. A length of the measuring part 820 may be parallel, or substantially parallel to the first direction D1, and a width of the measuring part 820 may extend in a diagonal direction with respect to the first direction D1 and the second direction D2.

Figure 8:
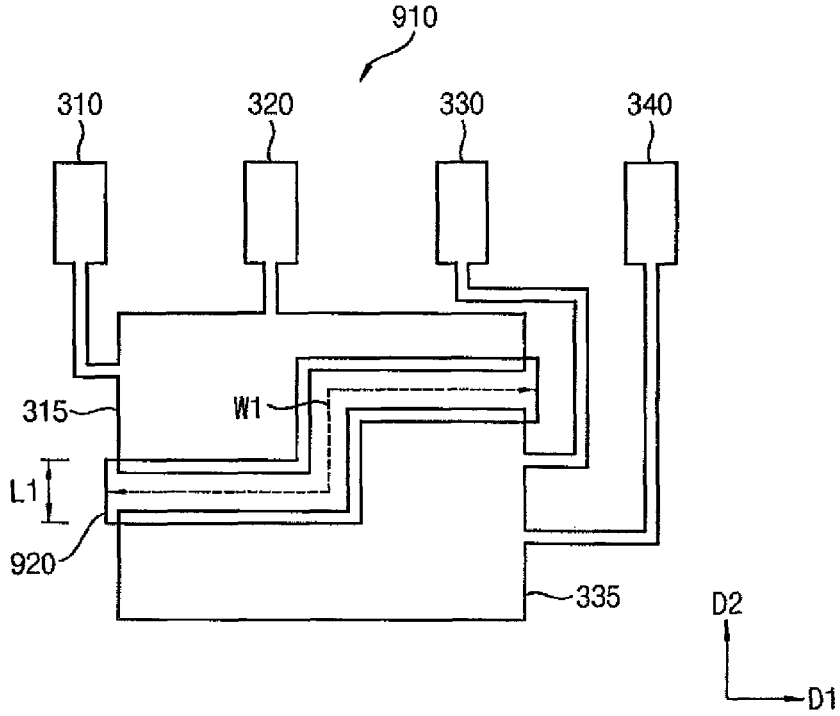
FIG. 8 is a plan view illustrating a TEG pattern for testing pixel electrodes, according to an exemplary embodiment of the present invention.

FIG. 8 is a plan view illustrating a TEG pattern for testing pixel electrodes, according to an exemplary embodiment of the present invention.

Referring to FIG. 8, a TEG pattern 910 for testing pixel electrodes according to an exemplary embodiment includes a first terminal part 310, a second terminal part 320, a third terminal part 330 and a fourth terminal part 340. The first to fourth terminal parts 310 to 340 are spaced apart from one another along a first direction D1. The first terminal part 310 and the second terminal part 320 may be connected to each other through a first extending part 315. The first terminal part 310, the second terminal part 320 and the first extending part 315 may be integrally formed. The third terminal part 330 and the fourth terminal part 340 may be connected to each other through a second extending part 335. The third terminal part 330, the fourth terminal part 340 and the second extending part 335 may be integrally formed. A portion of the TEG pattern 910 that includes the first to fourth terminal parts 310 to 340 may be referred to herein as a terminal pattern.

The first extending part 315 and the second extending part 335 extend in the first direction D1 and in a second direction D2 crossing the first direction D1 (e.g., the first and second directions D1 and D2 may be perpendicular, or substantially perpendicular to each other). For example, the first extending part 315 and the second extending part 335 may have substantially have "L" shapes.

A measuring part 920 may be disposed between the first extending part 315 and the second extending part 335. The measuring part 920 may partially overlap the first extending part 315 and the second extending part 335. The measuring part 920 may include a transparent conductive material.

In an exemplary embodiment, the measuring part 920 may substantially have a "Z" shape between the first extending part 315 and the second extending part 335. The measuring part 920 may have a first length L1 and a first width W1. In an exemplary embodiment, the first width W1 of the measuring part 920 may be about ten times greater than the first length L1 of the measuring part 920. Further, a length of the measuring part 920 may be parallel, or substantially parallel to the second direction D2, and a width of the measuring part 920 may be extended to be partially parallel to the first direction D1 and the second direction D2.

Figure 9:
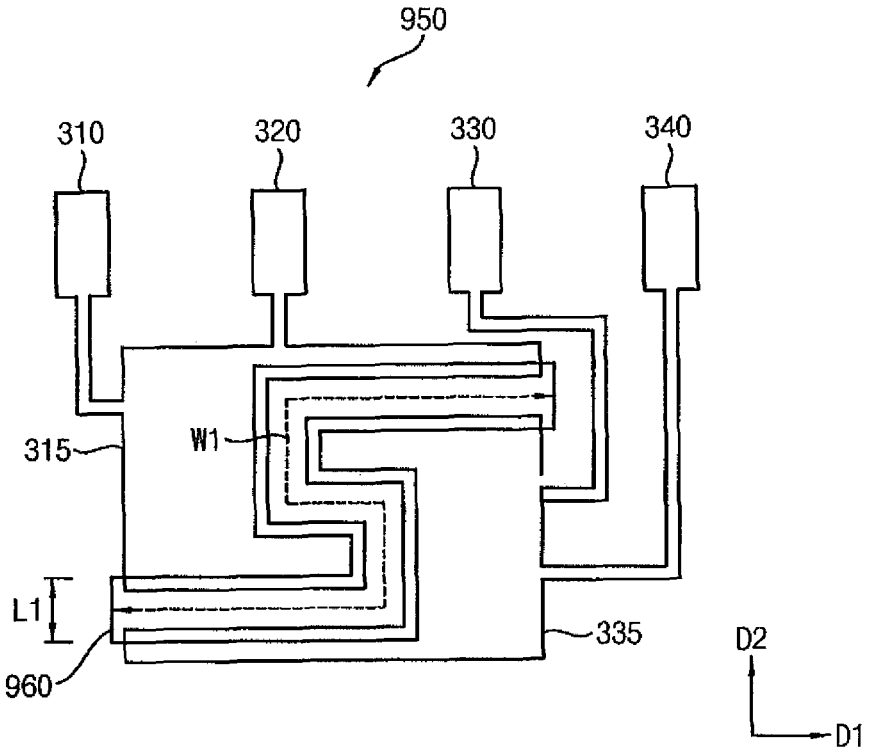
FIG. 9 is a plan view illustrating a TEG pattern for testing pixel electrodes, according to an exemplary embodiment of the present invention.

FIG. 9 is a plan view illustrating a TEG pattern for testing pixel electrodes, according to an exemplary embodiment of the present invention.

Referring to FIG. 9, a TEG pattern 950 for testing pixel electrodes according to an exemplary embodiment includes a first terminal part 310, a second terminal part 320, a third terminal part 330 and a fourth terminal part 340. The first to fourth terminal parts 310 to 340 are spaced apart from one another along a first direction D1. The first terminal part 310 and the second terminal part 320 may be connected to each other through a first extending part 315. The first terminal part 310, the second terminal part 320 and the first extending part 315 may be integrally formed. The third terminal part 330 and the fourth terminal part 340 may be connected to each other through a second extending part 335. The third terminal part 330, the fourth terminal part 340 and the second extending part 335 may be integrally formed. A portion of the TEG pattern 950 that includes the first to fourth terminal parts 310 to 340 may be referred to herein as a terminal pattern.

The first extending part 315 and the second extending part 335 extend in the first direction D1 and in a second direction D2 crossing the first direction D1 (e.g., the first and second directions D1 and D2 may be perpendicular, or substantially perpendicular to each other). For example, the first extending part 315 and the second extending part 335 may substantially have "U" shapes.

A measuring part 960 may be disposed between the first extending part 315 and the second extending part 335. The measuring part 960 may partially overlap the first extending part 315 and the second extending part 335. The measuring part 960 may include a transparent conductive material.

In an exemplary embodiment, the measuring part 960 may substantially have an "S" shape between the first extending part 315 and the second extending part 335. The measuring part 960 may have a first length L1 and a first width W1. In an exemplary embodiment, the first width W1 of the measuring part 960 may be about ten times greater than the first length L1 of the measuring part 960. Further, a length of the measuring part 960 may be parallel, or substantially parallel to the second direction D2, and a width of the measuring part 960 may be extended to be partially parallel to the first direction D1 and the second direction D2.

Exemplary embodiments of the present invention may be described as including a measuring part having a transverse side and a longitudinal side. One of the transverse side and the longitudinal side may be substantially parallel with the first direction D1 or the second direction D2. The transverse side may refer to, for example, a side of the measuring part that extends across the first and second extending parts, and the longitudinal side may refer to, for example, a side of the measuring part that extends lengthwise relative to the first and second extending parts.

Exemplary embodiments of the present invention are not limited to a TEG pattern having the shapes of the measuring parts 620, 720, 820, 920, 960 described herein. For example, according to exemplary embodiments of the present invention, the measuring part of the TEG pattern for testing pixel electrodes may have a variety of shapes including, for example, shapes having an elongated width and a relatively fixed length. That is, the width may be varied and the length may be fixed. Similarly, according to exemplary embodiments of the present invention, a first extending part and a second extending part may have a variety of shapes corresponding to the measuring part.

As described above, according to exemplary embodiments of the test structure, an array substrate having the test structure, and a method of measuring sheet resistance using the test structure, the width of the TEG pattern for testing pixel electrodes may be elongated to reduce the occurrence of an error when measuring sheet resistance using the TEG pattern when the pixel electrode layer is overly etched.

Further, according to exemplary embodiments of the present invention, the width of the TEG pattern for testing pixel electrodes may be elongated while the length of the TEG pattern for testing pixel electrodes is fixed, thereby preventing an unnecessary increase of an area of the test region. That is, the width of the TEG pattern may be varied and the length of the TEG pattern may be fixed.

While the present invention has been particularly shown and described with reference to the exemplary embodiments thereof, it will be understood by those of ordinary skill in the art that various changes in form and detail may be made therein without departing from the spirit and scope of the present invention as defined by the following claims.

What is claimed is:

1. A pattern structure, comprising:

a terminal pattern comprising a first terminal part, a second terminal part, a third terminal part and a fourth terminal part sequentially disposed and spaced apart from each other in a first direction;

a first extending part comprising a first connecting line connected to the first terminal part, a second connecting line connected to the second terminal part and a first extending pattern connected to the first and second connecting lines, wherein the first extending pattern has a rectangular shape having longer sides extending in a second direction crossing the first direction;

a second extending part comprising a third connecting line connected to the third terminal part, a fourth connecting line connected to the fourth terminal part and second extending pattern connected to the third and fourth connecting lines, wherein the second extending pattern has a rectangular shape having longer sides extending in the second direction; and a measuring part comprising a first side, a second side facing the first side, a third side and a fourth side facing the third side, wherein one of the longer sides of the first extending part is overlapped by the first side, and one of the longer sides of the second extending part is overlapped by the second side, wherein a length of the first side of the measuring part is greater than a length of the third side of the measuring part and a length of the fourth side of the measuring part, and a length of the second side of the measuring part is greater than the length of the third side of the measuring part and the length of the fourth side of the measuring part, wherein the first extending part is spaced apart from the second extending part.

2. The pattern structure of claim 1, wherein the measuring part is physically disposed between the second terminal part and the third terminal part.

3. The pattern structure of claim 1, wherein the length of the first side of the measuring part is about ten times greater than the length of the third side of the measuring part and the length of the fourth side of the measuring part, and the length of the second side of the measuring part is about ten times greater than the length of the third side of the measuring part and the length of the fourth side of the measuring part.

4. The pattern structure of claim 1, wherein a direction of the first side and the second side of the measuring part partially extends in a diagonal direction with respect to the first direction and the second direction.

5. The pattern structure of claim 1, wherein a direction of the first side and the second side of the measuring part partially extends in the first direction and partially extends in the second direction.

6. The pattern structure of claim 1, wherein the measuring part has one of a zigzag shape, an S shape and a Z shape.

7. The pattern structure of claim 1, wherein the measuring part comprises a transparent conductive material.

8. The pattern structure of claim 7, wherein the measuring part comprises indium tin oxide.

9. A method of measuring sheet resistance, comprising:

connecting a current generator to a first terminal part and a fourth terminal part of a terminal pattern, wherein the terminal pattern comprises the first terminal part, a second terminal part, a third terminal part and the fourth terminal part sequentially disposed and spaced apart from each other in a first direction, the first terminal part is connected to a first extending part that extends in a second direction crossing the first direction, and the fourth terminal part is connected to a second extending part that extends in the second direction;

connecting a voltmeter to the second terminal part and the third terminal part, wherein the second terminal part is connected to the first extending part, and the third terminal part is connected to the second extending part;

applying a current through the first and fourth terminal parts by the current generator; and measuring a voltage through the second and third terminal parts by the voltmeter while the current is applied through the first and fourth terminal parts to compute a sheet resistance of a measuring part, wherein the measuring part comprises a first side, a second side facing the first side, a third side and a fourth side facing the third side, wherein the first extending part is overlapped by the first side, and the second extending part is overlapped by the second side, wherein a length of the first side of the measuring part is greater than a length of the third side of the measuring part and a length of the fourth side of the measuring part, and a length of the second side of the measuring part is greater than the length of the third side of the measuring part and the length of the fourth side of the measuring part, wherein the first extending part is spaced apart from the second extending part.

10. The method of claim 9, wherein the length of the first side of the measuring part is about ten times greater than the length of the third side of the measuring part and the length of the fourth side of the measuring part, and the length of the second side of the measuring part is about ten times greater than the length of the third side of the measuring part and the length of the fourth side of the measuring part.

11. The method of claim 9, wherein a direction of the first side and the second side of the measuring part partially extends in the first direction and partially extends in the second direction.

12. An array substrate, comprising:

a display region comprising a plurality of signal lines;

a peripheral region comprising a driving circuit configured to provide an electrical signal to at least one of the signal lines, wherein the peripheral region is disposed adjacent to the display region; and a pattern region disposed in the peripheral region and comprising a plurality of test element group patterns, wherein the pattern region is spaced apart from the driving circuit, and the pattern region comprises:

a terminal pattern comprising a first terminal part, a second terminal part, a third terminal part and a fourth terminal part sequentially disposed and spaced apart from each other in a first direction;

a first extending part comprising a first connecting line connected to the first terminal part, a second connecting line connected to the second terminal part and a first extending pattern connected to the first and second connecting lines, wherein the first extending pattern has a rectangular shape having longer sides extending in a second direction crossing the first direction;

a second extending part comprising a third connecting line connected to the third terminal part, a fourth connecting line connected to the fourth terminal part and a second extending pattern connected to the third and fourth connecting lines, wherein the second extending pattern has a rectangular shape having longer sides extending in the second direction; and a measuring part comprising a first side, a second side facing the first side, a third side and a fourth side facing the third side, wherein one of the longer sides of the first extending part is overlapped by the first side, and one of the longer sides of the second extending part is overlapped by the second side, wherein a length of the first side of the measuring part is greater than a length of the third side of the measuring part and a length of the fourth side of the measuring part, and a length of the second side of the measuring part is grater than the length of the third side of the measuring part and the length of the fourth side of the measuring part, wherein the first extending part is spaced apart from the second extending part.

13. The array substrate of claim 12, wherein the length of the first side of the measuring part is about ten times greater than the length of the third side of the measuring part and the length of the fourth side of the measuring part, and the length of the second side of the measuring part is about ten times greater than the length of the third side of the measuring part and the length of the fourth side of the measuring part.

14. The array substrate of claim 12, wherein the display region comprises a pixel electrode, and the measuring part and the pixel electrode comprise a same material.

15. A test element group (TEG) pattern, comprising:

a first terminal part, a second terminal part, a third terminal part and a fourth terminal part sequentially disposed and spaced apart from each other in a first direction;

a first extending part comprising a first connecting line connected to the first terminal part, a second connecting line connected to the second terminal part and a first extending pattern connected to the first and second connecting lines, wherein the first extending pattern has a rectangular shape having longer sides extending in a second direction substantially perpendicular to the first direction;

a second extending part comprising a third connecting line connected to the third terminal part, a fourth connecting line connected to the fourth terminal part and a second extending pattern connected to the third and fourth connecting lines, wherein the second extending pattern has a rectangular shape having longer sides extending in the second direction; and a measuring part comprising a first side, a second side facing the first side, a third side and a fourth side facing the third side, wherein one of the longer sides of the first extending part is overlapped by the first side, and one of the longer sides of the second extending part is overlapped by the second side, wherein a length of the first side of the measuring part is greater than a length of the third side of the measuring part and a length of the fourth side of the measuring part, and a length of the second side of the measuring part is greater than the length of the third side of the measuring part and the length of the fourth side of the measuring part, wherein the first extending part is spaced apart from the second extending part.

16. The TEG pattern of claim 15, wherein the measuring part has one of a zigzag shape, an S shape and a Z shape.

* * * * *